United States Patent [19]

Brisco

[11] Patent Number: 4,658,895

[45] Date of Patent: Apr. 21, 1987

[54] GRAVEL PACK SAFETY SUB

[75] Inventor: David P. Brisco, Duncan, Okla.

[73] Assignee: Halliburton Company, Duncan, Okla.

[21] Appl. No.: 841,491

[22] Filed: Mar. 19, 1986

[51] Int. Cl.[4] ..... F21B 23/00

[52] U.S. Cl. ..... 166/237; 285/3; 285/330

[58] Field of Search ..... 166/51, 278, 228, 205, 166/237, 240, 102; 285/3, 4, 12, 330, 278; 166/181

[56] References Cited

U.S. PATENT DOCUMENTS

| | | | |
|---|---|---|---|
| 1,982,915 | 12/1934 | Jenks | 285/3 |
| 2,422,223 | 6/1947 | Church | 285/3 |
| 3,148,894 | 9/1964 | Schwab | 285/3 |
| 3,361,453 | 1/1968 | Brown et al. | 285/330 X |
| 3,499,664 | 3/1970 | Burns | 285/330 X |
| 3,552,492 | 1/1971 | Mullins | 166/237 X |
| 3,623,753 | 11/1971 | Henry | 285/330 |
| 4,519,451 | 5/1985 | Gray et al. | 166/51 X |
| 4,531,766 | 7/1985 | Crase | 285/3 X |

OTHER PUBLICATIONS

Otis Catalog Appendix p. 12 GP. 13.

Halliburton Services Sales and Service Catalog No. 43, pp. 2526, 2527, 2528, 2564 and 2565.

*Primary Examiner*—Stephen J. Novosad

*Assistant Examiner*—David J. Bagnell

*Attorney, Agent, or Firm*—Joseph A. Walkowski

[57] ABSTRACT

A gravel pack safety sub selectively positionable in rotational or a non-rotational mode. The safety sub includes an adapter having lugs thereon and a mandrel having lugs thereon adjacent the adapter. A retainer attached to the adapter receives an end of the mandrel. The mandrel and retainer define an annular cavity therebetween, and a sleeve is positioned in the cavity. The sleeve has a hole therein which is nearer a first end thereof than a second end. The hole is alignable with an exterior recess in the mandrel and a shear pin positioned therethrough. The safety sub may be placed in a first position wherein the second end of the sleeve is adjacent the adapter and the lugs on the mandrel and adapter are separated. A bearing ring is positioned between the adapter and the mandrel for maintaining the separation of the lugs and providing a bearing surface therebetween. In a second position, the sleeve is reversed such that the first end thereof is adjacent the mandrel and the lugs are mutually engaged, thus preventing relative rotation between the adapter and mandrel. No bearing ring is used in the second position. If the bearing ring is removed from the apparatus when in the first position, the adapter and mandrel may be moved between the first and second positions.

12 Claims, 4 Drawing Figures

GRAVEL PACK SAFETY SUB

BACKGROUND OF THE INVENTION

1. Field of the Invention

This invention relates to safety subs for tool strings used in downhole gravel packing, and more particularly, to a safety sub selectively positionable in a rotational or a non-rotational mode.

2. Description of the Prior Art

The typical gravel packing tool string has a liner screen which is positioned adjacent the well formation to be packed and a gravel packer positioned above the screen. Means are included between the packer and screen as necessary for allowing movement of the tool string for unsetting the packer after gravel packing and for releasing the screen from the tool string so that the packer and other tool string elements may be removed from the hole while leaving the gravel packed liner screen in place. On some occasions, the means for releasing may fail to function, typically because sand gets into the mechanism. If this occurs, another method of removing the packer and tool string must be used.

Many packers require rotation for unsetting from the well bore. Because the gravel packed liner screen is stationary after the gravel packing, and rotation of the screen is extremely undesirable, swivel means are provided between the liner screen and packer so that rotation may occur above the swivel for unsetting the packer, while such rotation is not transmitted to the liner screen.

Swivel joints have been developed which include a shear connection therein so that if the releasing means fails to operate, an upward pull on the tool string will shear the shear connection without disturbing the location of the liner screen. Thus, all portions of the tool string, including the packer, above the shear connection in the swivel joint may then be removed from the hole.

For packers which require lifting for unsetting, a clutch joint is typically used. The clutch joint will not transmit rotation to the liner screen while unsetting the packer, but will transmit rotation for rotational disengagement from the liner screen after unsetting of the packer. A swivel joint is not required, and usually no shear joint is employed.

There is a need for shear joints in cases even where rotational disengagement from the screen is utilized. Also, because it may not be known which type of packer may be required or desired, there is a need for a shearable swivel joint, or safety sub, which can be selectively positioned in either a rotational mode or a non-rotational mode. The present invention provides such an apparatus.

SUMMARY OF THE INVENTION

The gravel pack safety sub of the present invention comprises adapter means attachable to a tool string portion and having lug means thereon, mandrel means attachable to another tool string portion and having lug means thereon facing the lug means on the adapter means, and reversible connecting means for selectively connecting the mandrel means to the adapter means in a first position in which the lug means on the mandrel means are separated from the lug means on the adapter means and a second position in which the lug means are mutually engaged. The first position defines a rotational mode and allows relative rotation between the adapter means and the mandrel means, and the second position defines a non-rotational mode and prevents relative rotation between the adapter means and the mandrel means. The safety sub further comprises shear means for providing shearable separation of the adapter means from the mandrel means when the tool string portions are pulled apart. The safety sub also comprises bearing means positioned between the lug means on the adapter means and the lug means on the mandrel means when the safety sub is in the first position. The bearing means are removed when the safety sub is in the second position.

Preferably, the mandrel means defines an outwardly opening recess thereon, and the reversible connecting means comprises a retainer attached to the adapter means and defining a central opening therethrough for slidably receiving a portion of the mandrel means such that the retainer and mandrel means define an annular cavity therebetween in communication with the recess on the mandrel means, a sleeve positionable in the cavity and having a first end and a second end. The sleeve defines a transverse hole therethrough longitudinally nearer the first end of the sleeve than the second end of the sleeve, and the hole in the sleeve is alignable with the recess on the mandrel means. The reversible connecting means further comprises a pin extending through the hole in the sleeve into the recess in the mandrel means, thereby connecting the sleeve to the mandrel means. The sleeve may be positionable in a first position, corresponding to the safety sub first position, in which the second end of the sleeve is adjacent the adapter means and a second position, corresponding to the safety sub second position, in which the first end of the sleeve is adjacent the adapter means. The shear means are best characterized by the pin being a shear pin.

The mandrel means and the sleeve attached thereto are longitudinally slidable within the retainer such that the mandrel means and adapter means may be longitudinally moved between the first position when the tool string portions are in tension and the second position when the tool string portions are in compression. When the bearing means are in place in the safety sub, this lognitudinal sliding movement is prevented.

The retainer further comprises shoulder means for engaging the sleeve such that when the shear pin is sheared, the sleeve remains positioned in the retainer. Sealing means are also provided for sealing between the retainer and the mandrel means.

The safety sub may be used as part of a downhole tool which also comprises a packer and a liner screen adapted for gravel packing. Preferably, the tool string also comprises releasing means positioned between the safety sub and the liner screen for releasing the liner screen. In one embodiment of the downhole tool, the packer is of a type requiring rotation for unsetting thereof, the releasing means comprises a hydraulic release tool, and the safety sub is in the first position. In another embodiment, the packer is of a type requiring lifting for unsetting thereof, the releasing means comprises a rotationally disengageable connection to the liner screen, and the safety sub is in the second position. In this embodiment, the tool preferably also comprises a clutch joint between the safety sub and the releasing means.

An important object of the present invention is to provide a safety sub that may be selectively positioned in a rotational mode allowing relative rotation between the tool string portions above and below the safety sub and a nonrotational mode preventing relative rotation of the tool string portions.

Another object of the invention is to provide a safety sub having an adapter with a lug thereon and a mandrel with a lug thereon which can be selectively locked or unlocked.

Still another object of the present invention is to provide a safety sub which is shearable in tension.

A further object of the invention is to provide a downhole tool including a packer, liner screen and a safety sub which is selectably positionable for allowing or preventing relative rotation between the packer and the liner screen.

Additional objects and advantages of the invention will become apparent as the following detailed description of the preferred embodiment is read along with the drawings which illustrate such preferred embodiment.

DESCRIPTION OF THE PREFERRED EMBODIMENT

Figure 1:
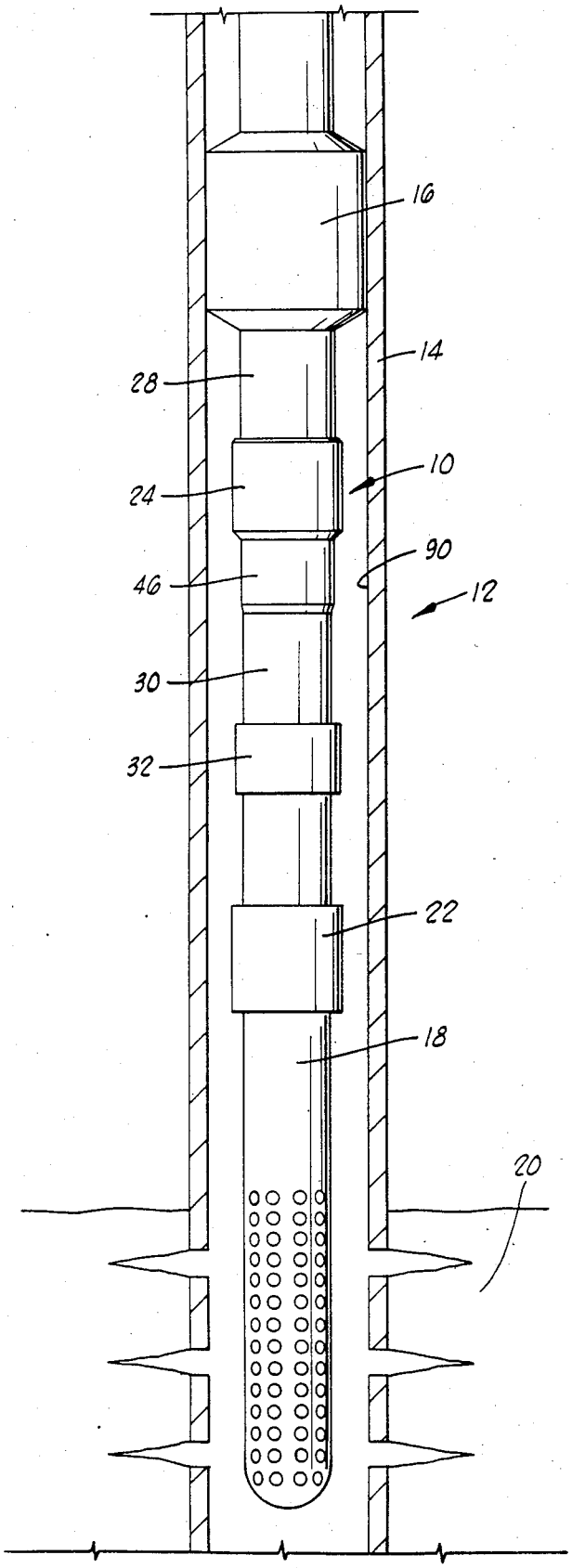
FIG. 1 schematically illustrates a typical gravel packing tool string including the gravel pack safety sub of the present invention.

Referring now to the drawings, and more particularly to FIG. 1, the gravel packing safety sub of the present invention is shown, and generally designated by the numeral 10, forming a part of a gravel packing tool string 12 positioned in a well casing 14.

Tool string 12 also includes a gravel packer 16 above safety sub 10 and a liner screen 18 below the safety sub. Liner screen 18 is positioned adjacent a well formation 20 to be packed. Releasing means 22 are provided above liner screen 18 for disengagement of tool string 12 therefrom. FIG. 1 is a general representation of a tool string and releasing means 22 are intended therein to include any devices normally located in a gravel packing tool string between packer 16 and liner screen 18. Such devices include, but are not limited to, a hydraulic release tool and a clutch joint with a rotationally disengageable threaded connection.

Figure 2:
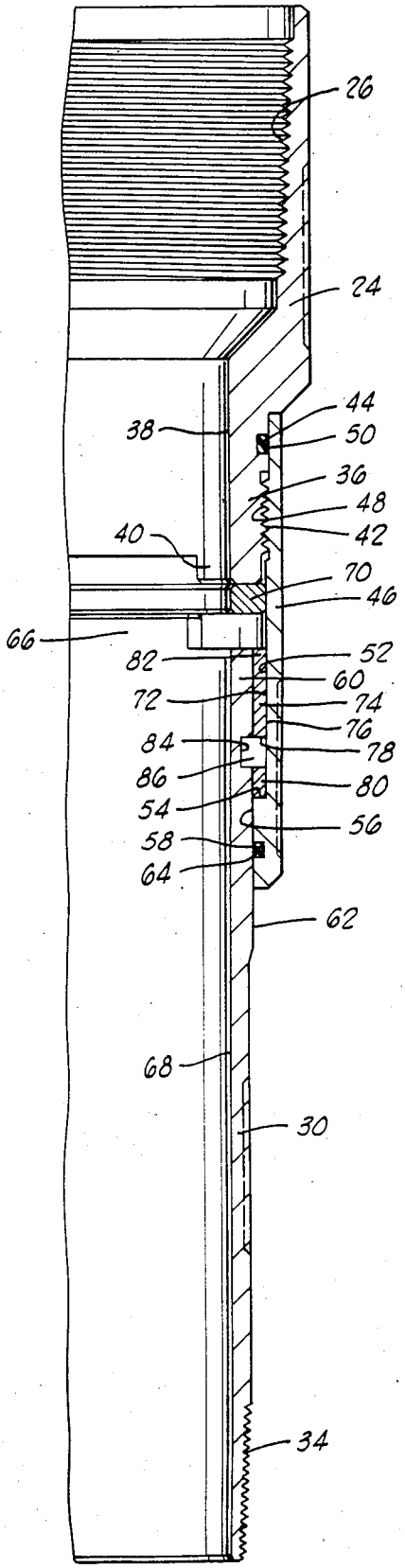
FIG. 2 is a longitudinal cross section of the gravel pack safety sub of the present invention shown in a rotational mode.

Referring now also to FIG. 2, safety sub 10 includes adapter means in the form of an adapter 24 with a threaded upper end 26 for connection to an upper tool string portion 28. Mandrel means are positioned adjacent the adapter means and are preferably in the form of a mandrel 30 connected to a lower tool string portion 32 by a threaded lower end 34.

Adapter 24 has a lower end 36 opposite upper end 26 and has a central opening 38 therethrough in communication with the rest of tool string 12. Lower end 36 of adapter 24 includes at least one downwardly facing dog or lug 40 and an externally threaded portion. Preferably, two lugs 40 are spaced circumferentially opposite one another. An annular seal recess 44 faces outwardly above threaded portion 42 on adapter 24.

An annular retainer 46 has an internally threaded upper end 48 which is threadingly engaged with threaded portion 42 of adapter 24. Sealing means, such as O-ring 50, are disposed in seal cavity 44 for providing sealing engagement between adapter 24 and retainer 46.

Retainer 46 has an intermediate inner cylindrical surface 52 with an upwardly facing shoulder 54 at a lower end thereof extending inwardly toward another inner cylindrical surface 56. An annular seal recess 58 is defined in cylindrical surface 56.

Mandrel 30 has an upper end 60, opposite lower end 34, which has an outer cylindrical surface 62 adapted for close, sliding relationship with cylindrical surface 56 of retainer 46. Sealing means, such as an O-ring 64, are provided in seal recess 58 for sliding or rotational, sealing engagement between cylindrical surface 62 of mandrel 40 and cylindrical surface 56 of retainer 46.

Upper end 60 of mandrel 30 includes at least one upwardly facing dog or lug 66, and in the preferred embodiment, two such lugs 66 are spaced circumferentially opposite one another.

Mandrel 30 defines a central opening 68 therethrough in communication with central opening 38 in adapter 24.

In the rotational mode embodiment shown in FIG. 2, lugs 66 on mandrel 30 are spaced apart from lugs 40 on adapter 24. Thus, lugs 40 and 66 are unlocked. In this embodiment, an annular bearing ring 70 is positioned between adapter 24 and mandrel 30. Bearing ring 70 prevents engagement of lugs 66 and lugs 40 and provides a bearing surface for easy relative rotation between mandrel 30 and adapter 24. Because retainer 46 is threadingly engaged, and thus fixed, with respect to adapter 24, it will be seen that O-ring 64 provides a rotational seal between mandrel 30 and retainer 46.

It further will be seen that an annular cavity 72 is defined between cylindrical surface 52 of retainer 46 and cylindrical surface 62 of mandrel 30. An annular sleeve 74 is disposed in cavity 72 and has an outer cylindrical surface 76 which is in close, sliding relationship with cylindrical surface 52 of retainer 46.

Sleeve 74 defines a radially oriented, transverse hole 78 therethrough. Transverse hole 78 is longitudinally nearer to a first end 80 of sleeve 74 than a second end 82 of the sleeve. Mandrel 30 also has a radially oriented transverse recess 84 in cylindrical surface 62. Hole 78 in sleeve 74 is aligned with recess 84 in mandrel 30, and a shear pin 86 is positioned through the hole 78 into the recess 84, providing shear means for shearably attaching sleeve 74 to mandrel 30.

In the rotational mode shown in FIG. 2, second end 82 of sleeve 74 is adjacent and facing adapter 24, and first end 80 of the sleeve is adjacent shoulder 54 in retainer 46. Thus, lugs 66 on mandrel 30 and lugs 40 on adapter 24 are separated, as hereinbefore described. Bearing ring 70 prevents relative longitudinal movement between adapter 24 and mandrel 30. Because sleeve 74 is pinned to mandrel 30, there is relative rotation between retainer 46 and sleeve 74 when there is relative rotation between retainer 46 and mandrel 30.

Figure 3:
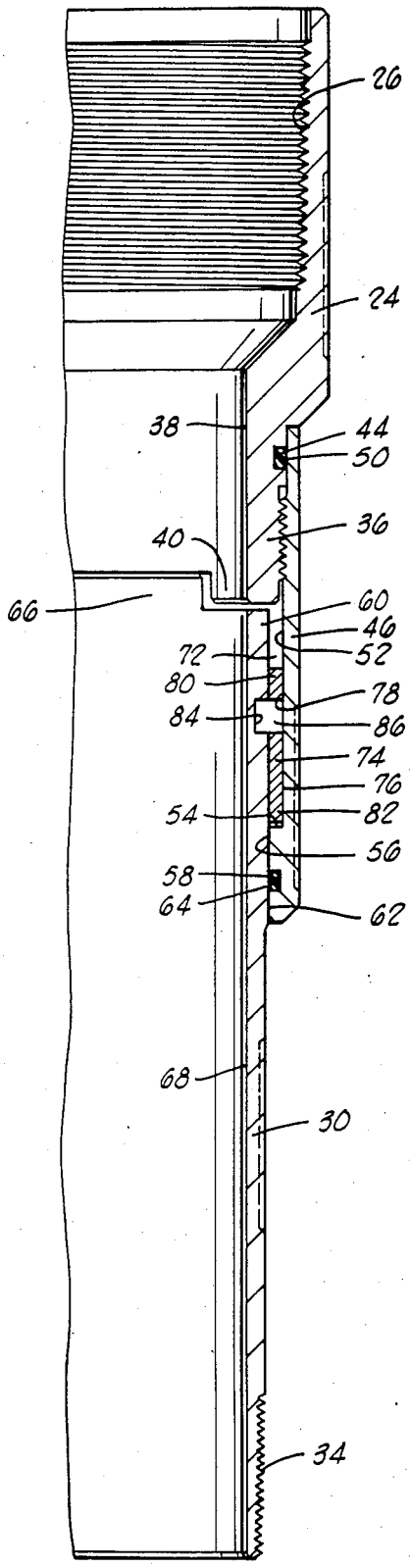
FIG. 3 is a cross section of the apparatus in a nonrotational mode.

Referring now to FIG. 3, the non-rotational mode of safety sub 10 is shown. In this configuration, bearing ring 70 is removed, and sleeve 74 is reversed with respect to the position of the sleeve shown in the rotational mode of FIG. 2. In other words, first end 80 of sleeve 74 is adjacent and facing adapter 24, and second end 82 of the sleeve is adjacent shoulder 54 in retainer 46. When hole 78 and recess 84 are aligned and shear pin 86 is in place therethrough, it will be seen that lugs 66 on mandrel 30 must be engaged with lugs 40 on adapter 24. Thus, lugs 40 and 66 are locked, and when adapter 24 is rotated, mandrel 30, and sleeve 74 pinned thereto, must rotate with adapter 24 and retainer 46. Mandrel 30 is obviously positioned further upwardly with respect to adapter 24 when in the nonrotational mode of FIG. 3. O-ring 64 is simply a static seal because there is no relative rotation between mandrel 30 and retainer 46.

Figure 4:
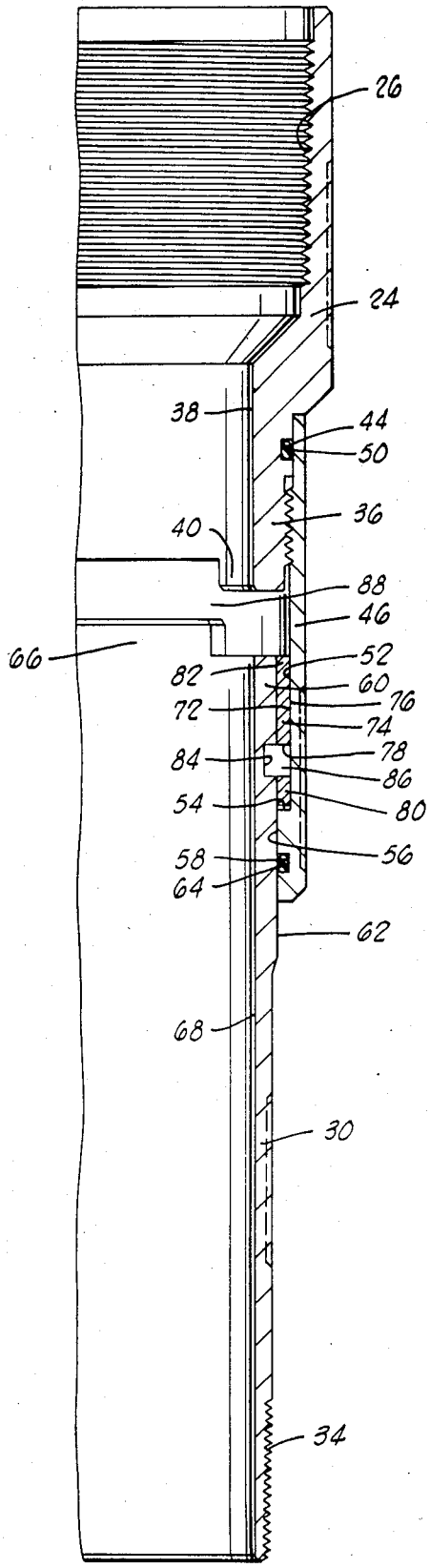
FIG. 4 shows the apparatus of the present invention in an operationally selective rotational/non-rotational mode.

An operationally selective rotational/non-rotational mode is illustrated in FIG. 4. The configuration in FIG. 4 is essentially identical to that of the rotational mode shown in FIG. 2, except that bearing ring 70 is removed. In other words, second end 82 of sleeve 74 is adjacent and facing adapter 24 and first end 80 of the sleeve is adjacent shoulder 54 in retainer 46. When tool string 12 is in tension, lugs 66 on mandrel 30 and lugs 40 on adapter 24 are separated and unlocked such that there is a gap 88 therebetween. When tool string 12 is in compression, adapter 24 and retainer 46 are moved relatively downwardly with respect to mandrel 30 and sleeve 74. In this way, lugs 66 on mandrel 30 and lugs 40 on adapter 24 may be engaged and locked. It will thus be clear to those skilled in the art that when the tool string is in tension, safety sub is in a rotational mode in which rotation of adapter 24 will not be transmitted to mandrel 30. However, when the tool string is in compression, lugs 66 and 40 are engaged, so that safety sub 10 is in a non-rotational mode in which rotation of adapter 24 rotates mandrel 30.

OPERATION OF THE APPARATUS

The various modes hereinbefore described may be used with a variety of packers in several situations. In each case, a tool string, similar to tool string 12 shown in FIG. 1, is used. Tool string 12 is lowered into well bore 90 defined by casing 14 such that liner screen 18 is positioned adjacent formation 20. Packer 16 is set, and the gravel packing operation is carried out. At this point, it is necessary to disconnect from liner screen 18 and remove the rest of tool string 12 from well bore 90, leaving the gravel packed liner screen in place adjacent formation 20.

In one typical gravel packing tool string, unsetting of gravel packer 16 requires rotation. A typical gravel packer of this type is the SANDCHIEF gravel packer manufactured by Halliburton Services and illustrated on pages 2526 and 2527 of Halliburton Services' Sales and Service Catalog No. 43. These gravel packers are typically run in the tool string with releasing means 22, such as a hydraulic release tool which allows liner screen 18 to be hydraulically released; examples of such tools include the Halliburton Services HR Valve and HR Crossover also illustrated on page 2527 of the aforementioned catalog. The hydraulic release tool is actuated before the unsetting operation of the packer or, if the liner screen is on the bottom of the well, perhaps even before the gravel packing operation is carried out. With such a configuration, safety sub 10 is installed in tool string 12 in the rotational mode shown in FIG. 2. In this way, rotation of the tool string to unset packer 16, which will also rotate adapter 24 and retainer 46, will transmit no rotation to mandrel 30 and therefore no rotation to the hydraulic release tool or liner screen 18. In this way, safety sub 10 functions in the same manner as any swivel joint previously known in the art.

If the hydraulic release tool fails to operate, packer 16 can still be unset, and by lifting on tool string 12, shear pin 86 will be sheared so that packer 16 and the reset of tool string 12 above mandrel 30 may be removed from well bore 90. It will be seen that the only remaining portion of safety sub 10 will be mandrel 30. Adapter 24, retainer 46, bearing ring 68 and sleeve 74 will all be removed from well bore 90.

Packers for gravel packing which require lifting for unsetting, such as the Halliburton Services Champ® III packer, modified for circulating gravel packs are frequently run with a clutch joint. The Champ® III packer is illustrated and described on pages 2564 and 2565 of the Halliburton Services Sales and Service Catalog No. 43. Such a clutch joint is positioned below packer 16 in the position indicated by reference numeral 22 in FIG. 1. The clutch joint has an extended position in which rotation of the upper tool string portion is transmitted through the clutch joint to the tool string portion below the clutch joint, and a collapsed position in which rotation of the tool string portion above the clutch joint is not transmitted therebelow. For such tool strings, liner screen 18 must be on the bottom of the well. When liner screen 18 touches bottom, further lowering of tool string 12 places the clutch joint in the converged, non-rotation transmitting configuration. Packer 16 is set and the gravel packing operation carried out.

For unsetting packer 16, tool string 12 is picked up to move the clutch joint to the extended position. Rotation of the tool string then threadingly disengages the clutch joint from a threaded connection with liner screen 18. Obviously, a swivel joint between the packer and clutch joint would be useless because no rotation could be transmitted to the clutch joint for disengagement from liner screen 18.

When the safety sub of the present invention is in the non-rotational mode shown in FIG. 3, it provides a useful safety shear point when located between packer 16 and the clutch joint. In this non-rotational mode, rotation of tool string 12, and thus adapter 24, will transmit rotation through lugs 40 and 66 to mandrel 30 and the tool string portions therebelow, including the clutch joint. In this way, safety sub 10 simply provides another solid joint in tool string 12. However, in the event that the clutch joint becomes stuck in the converged position or if tool string 12 cannot otherwise be rotationally disengaged from liner screen 18, lifting of the tool string will again cause shear pin 86 to be sheared to allow packer 16 and a majority of tool string 12 to be removed from well bore 90.

In some situations, the gravel packer is left in the hole after gravel packing around the liner screen, and only the setting tool is removed. Such a gravel packer is the Halliburton SANDPRO gravel packer, as disclosed in U.S. patent application Ser. No. 827,993. For such a gravel packer, safety sub 10 may be run in the tool string directly below the gravel packer in the non-rotational mode, shown in FIG. 3. Safety sub 10 merely acts as a solid joint in the tool string throughout the gravel packing operation and when the setting tool is removed. However, it may be desirable to later remove the packer if the packer does not set properly or when the gravel pack around the liner screen deteriorates and repacking is required. Safety sub 10 provides a shear joint which allows pulling the packer out of the hole prior to removing the screen liner. Even if the gravel packer does not unset properly, because of sand or other debris locked therein, safety sub 10 in its nonrotational mode provides a solid joint so that milling over the gravel packer is facilitated should it become necessary.

In the operationally selective rotational/non-rotational mode shown in FIG. 4, the operator may position safety sub 10 in the rotational mode by lifting on tool string 12 or place safety sub 10 in the non-rotational mode by setting down the weight of the tool string as desired. Of course, the shear feature is still available when sufficient lifting force is applied to cause shear pin 86 to be sheared.

A major advantage of safety sub 10 over previous simple swivel shear subs is that it may be rotationally locked, thus increasing its versatility. In many cases, the operator will not have prior knowledge of the type of gravel packing tool string desired or available. The safety sub of the present invention may be easily selectively preset to any of its operational modes to suit any kind of packing apparatus, as hereinbefore described. Thus, only a single safety sub must be maintained on hand.

It can be seen, therefore, that the gravel pack safety sub of the present invention is well adapted to carry out the ends and advantages mentioned, as well as those inherent therein. While a presently preferred embodiment of the apparatus, and of several operational modes thereof, have been described for the purposes of this disclosure, numerous changes in the construction and arrangement of parts, and in the method of operation, may be made by those skilled in the art. All such changes are encompassed within the scope and spirit of the appended claims.

What is claimed is:

1. A safety sub comprising:

adapter means attachable to a tool string portion and having lug means thereon;

mandrel means attachable to another tool string portion, said mandrel means defining an outwardly opening recess thereon and having lug means thereon facing said lug means on said adapter means;

reversible connecting means for selectively connecting said mandrel means to said adapter means in a first position in which said lug means on said mandrel means are separated from said lug means on said adapter means for allowing relative rotation between said adapter means and said mandrel means and a second position in which said lug means are mutually engaged for preventing relative rotation between said adapter means and said mandrel means, said reversible connecting means comprising:

a retainer attached to said adapter means and defining a central opening therethrough for slidably receiving a portion of said mandrel means, said retainer and said mandrel means defining an annular cavity therebetween in communication with said recess on said mandrel means;

a sleeve positionable in said cavity and having a first end and a second end, said sleeve defining a transverse hole therethrough longitudinally nearer said first end of said sleeve than said second end of said sleeve, said hole in said sleeve being alignable with said recess on said mandrel means; and a pin extending through said hole in said sleeve into said recess on said mandrel means;

said sleeve having a first position, corresponding to said safety sub first position, in which said second end of said sleeve is adjacent said adapter means and a second position, corresponding to said safety sub second position, in which said first end of said sleeve is adjacent said adapter means.

2. The safety sub of claim 1 further comprising shear means for providing shearable separation of said adapter means from said mandrel means.

3. The safety sub of claim 1 further comprising bearing means positioned between said lug means on said adapter means and said lug means on said mandrel means when in said first position, said bearing means being removed when in said second position.

4. The safety sub of claim 1 wherein said mandrel means and said sleeve attached thereto are longitudinally slidable within said retainer such that said mandrel means and adapter means may be longitudinally moved between said first position when said tool string portions are in tension and said second position when said tool string portions are in compression.

5. The safety sub of claim 1 wherein said pin is a shear pin shearable when said tool string portions are pulled apart for allowing separation of said mandrel means and said adapter means.

6. The safety sub of claim 5 wherein said retainer further comprises shoulder means for engaging said sleeve such that when said shear pin is sheared, said sleeve remains positioned in said retainer.

7. The safety sub of claim 1 further comprising sealing means for sealing between said retainer and said mandrel means.

8. A safety sub comprising:

an adapter adapted for attachment to a tool string portion and having an end with at least one lug thereon;

a retainer attachable to said adapter and having an open end;

a mandrel adapted for attachment to another tool string portion and having an end with at least one lug thereon facing said end with said lug on said adapter, said end of said mandrel defining a radially oriented recess therein and being slidably receivable in said open end of said retainer, said mandrel and retainer defining an annular cavity therebetween;

an annular sleeve defining a radially oriented hole therethrough nearer a first longitudinal end thereof than a second longitudinal end thereof, said sleeve being slidable with respect to said retainer and having a first position in which said second end of said sleeve faces said adapter and a second position in which said first end of said sleeve faces said adapter, said sleeve further selectably positionable in one of said first and second positions such that said hole in said sleeve is aligned with said recess in said mandrel; and a pin positionable in said hole and said recess for fixedly attaching said sleeve to said mandrel in said one of said first and second positions;

wherein:

when said sleeve is in said first position, said adapter and mandrel are longitudinally slidable between a relatively converged position in which said lugs are mutually engaged for preventing relative rotation between said adapter and mandrel and a relatively extended position in which said lugs are disengaged for allowing relative rotation between said adapter and said mandrel; and when said sleeve is in said second position, said adapter and mandrel are maintained in said relatively converged position in which said lugs are mutually engaged for preventing relative rotation between said adapter and said mandrel.

9. The safety sub of claim 8 further comprising a bearing ring positionable between said adapter and said mandrel when said sleeve is in said first position for maintaining said adapter and said mandrel in said relatively extended position and preventing engagement of said lugs.

10. The safety sub of claim 8 wherein said pin is shearable for allowing separation of said adapter and said mandrel upon application of a sufficient upward force on the tool string.

11. The safety sub of claim 8 further comprising sealing means for sealing between said retainer and said mandrel.

12. The safety sub of claim 8 wherein said retainer comprises shoulder means adjacent said first end of said sleeve when said sleeve is in said first position and adjacent said second end of said sleeve when said sleeve is in said second position.

* * * * *